United States Patent [19]

Gunkinger

[11] Patent Number: 4,875,256

[45] Date of Patent: Oct. 24, 1989

[54] METHOD AND APPARATUS FOR REPLACING EMPTY SLIVER CANS WITH FULL SLIVER CANS IN A DRAW FRAME

[75] Inventor: Siegfried Gunkinger, Heiningen, Fed. Rep. of Germany

[73] Assignee: Zinser Textilmaschinen GmbH, Fed. Rep. of Germany

[21] Appl. No.: 224,998

[22] Filed: Jul. 27, 1988

[30] Foreign Application Priority Data

Jul. 30, 1987 [DE] Fed. Rep. of Germany ..... 3725265

[51] Int. Cl.[4] ..... D04H 11/00

[52] U.S. Cl. ..... 19/159 A

[58] Field of Search ..... 19/159 A, 159 R, 157

[56] References Cited

U.S. PATENT DOCUMENTS

| | | | |
|---|---|---|---|
| 3,038,216 | 6/1962 | Naegeli | 19/157 |
| 3,808,641 | 5/1974 | Schneider et al. | 19/159 A |
| 4,208,768 | 6/1980 | Bonner, Sr. | 19/159 A |

*Primary Examiner*—Werner Schroeder
*Assistant Examiner*—D. Price
*Attorney, Agent, or Firm*—Shefte, Pinckney & Sawyer

[57] ABSTRACT

Full sliver cans are positioned in readiness for replacing cans being emptied with an end of the sliver exposed from the full can. A movable carriage is positioned at a full can and a gripper on the carriage extending vertically downward is rotated around the can to grasp the exposed end with suction. Any excess length of sliver is severed. The gripper is then raised to lift the sliver end and the gripper is pivoted in its raised position above a feed table onto which the gripper releases the sliver end for feeding on the table to the draw frame with the other slivers thereon. The full can whose sliver end is on the feed table is then pushed from the ready position into the sliver feed position and in doing so pushes the empty can out of sliver feed position to complete the replacement.

27 Claims, 3 Drawing Sheets

METHOD AND APPARATUS FOR REPLACING EMPTY SLIVER CANS WITH FULL SLIVER CANS IN A DRAW FRAME

BACKGROUND OF THE INVENTION

The present invention relates to a method and apparatus for replacing sliver cans in a draw frame of the type wherein slivers from several cans are fed into the draw frame, and more particularly to such a method and apparatus wherein empty sliver cans are replaced by full sliver cans with the slivers from the full cans being grasped and positioned into the draw frame.

In operation of conventional draw frames, slivers are fed from cans to the draw frame with empty cans being replaced by full cans manually by an attendant who removes the end of a sliver from a full can and manually initiates feeding to the draw frame. This manual replacing of the cans and sliver involves considerable energy and dexterity on the part of the operator. Furthermore, a uniformly proper initiation of the sliver into the system of slivers is not readily accomplished manually.

SUMMARY OF THE INVENTION

By the present invention, replacing of sliver cans and feeding of sliver ends into a draw frame is accomplished consistently without manual error and in a manner that provides uniformly consistent initiation of sliver feeding, thus enhancing the quality and economy of drawing.

Briefly described, the method and apparatus of the present invention provides for positioning a full sliver can in readiness for replacing a can being emptied by the draw frame and with an end of the sliver exposed from the full can. A movable carriage is positioned at the full can with a gripper carried on the carrier for grasping the exposed end of sliver and placing the grasped sliver end into the draw frame by manipulation of the gripper. The full can is then shifted into sliver feeding position and the empty can is shifted out of sliver feeding position. The apparatus of the present invention proivdes means for accomplishing the foregoing.

By the present invention, the replacement of cans and the insertion of the sliver is performed automatically so that inaccuracies or errors arising from manual handling are reliably avoided. The replacement process can, therefore, be precisely determined and set in advance so that an exact incorporation of the sliver start into the sliver system is possible. In this manner, starting position in the drawn sliver can be improved. The replacement process is reproducible by the automatic operation so that a drawn sliver with uniformly high quality is consistently obtained.

According to the method of the present invention, the sliver gripper is preferably moved around the periphery of the full can to assure grasping of the exposed sliver end. Also, preferably, suction is provided in the gripper to draw the exposed sliver end to the gripper for grasping thereby. Thus, the location and grasping of the sliver end is achieved in a simple and reliable manner. The only prerequisite for this operation is that the sliver end hang down to some extent on the outer wall of the full sliver can. A searching rotation of the gripper is then sufficient to locate and draw in the sliver by suction in substantially all cases.

To provide for uniformity of the initial sliver feed, any excess length of grasped sliver is severed before the sliver is placed into the draw frame.

In the preferred embodiment of the present invention, the sliver is placed by the gripper onto a feed table that serves to feed the slivers to the draw frame. The slivers are arranged on the table in parallel adjacent to each other and new sliver ends are placed by the gripper onto the feed table so that they are carried along by the other slivers. Further, according to a feature of the method of the present invention, the full cans are shifted into sliver feeding position in a manner by which the full cans push the empty cans out of sliver feeding position.

Briefly described, the apparatus of the present inventon performs the above-described method utilizing a movable carriage with means for moving the carriage to positions at the full cans and with sliver gripping means mounted on the carriage and operable to grasp the end of this liver exposed from a can at which the carriage is positioned. The gripping means places the sliver end into the draw frame. Means are provided for shifting the full sliver cans into sliver feeding positions and empty cans out of sliver feeding position.

The new, full sliver cans are placed in readiness by an operator or automatically with the aid of appropriate devices. The carriage can travel, for example, on tracks and be moved to operating position where the gripper grasps the sliver exposed from the full can and feeds it to the draw frame for further processing. Then the full can is pushed into sliver feeding position and the replacement procedure terminated.

Preferably, the apparatus includes means for rotating the gripper or gripping means around the periphery of the full cans to assure grasping of the exposed sliver end that is hanging down the side of the can. In this regard, it is advantageous to include suction means in the gripping means to draw the exposed sliver end to the gripping means for grasping thereby. Thus, grapsing of the sliver is virtually assured.

In the preferred embodiment, the sliver cans are located in a sliver feeding position under a feed table. When a sliver end of a full sliver can has been grapsed by the gripping means, it is placed onto the feed table and the full can is pushed from its ready position into sliver feeding position. The new sliver is entrained by the other slivers on the feed table and thereby fed to the draw frame. Preferably, means are provided to raise the gripping means to lift the grapsed sliver end for placing it into the draw frame and means are provided for pivoting the gripping means after it has been raised so that the placing of the sliver end will be onto the feed table. The raising and pivoting of the gripping means can be accomplished by appropriate piston-cylinder mechanisms.

Also, in the preferred embodiment of the apparatus the shifting means includes means for pushing full cans into sliver feeding position and thereby causing the full cans to push the empty cans out of sliver feeding position. This is preferably accomplished using piston-cylinder mechanisms and a pusher plate operated by the mechanisms and acting against the full cans to push them into sliver feed position.

Further features and advantages of the present invention will be apparent from the accompanying drawings and the following detailed description of the preferred embodiment.

DETAILED DESCRIPTION OF THE PREFERRED EMBODIMENT

Figure 1:
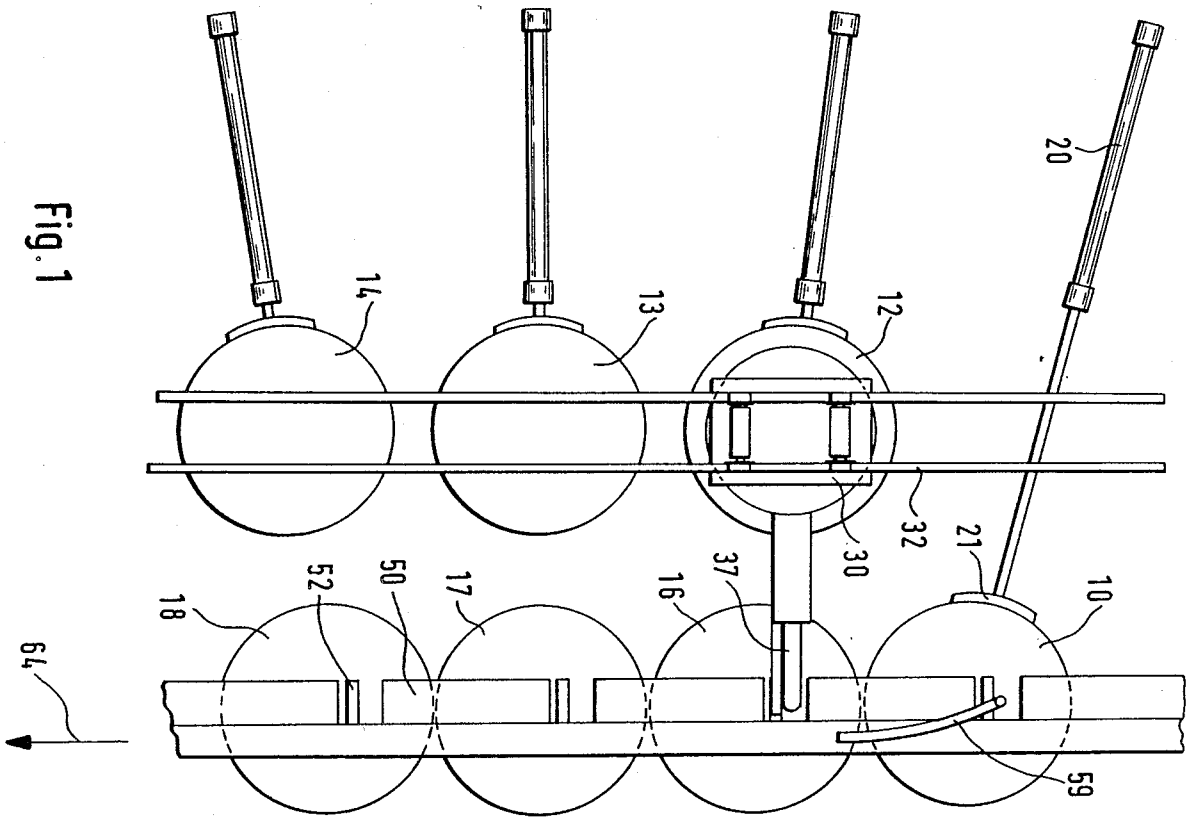
FIG. 1 is a schematic plan of an apparatus for replacing empty sliver cans with full sliver cans in a draw frame according to the preferred embodiment of the present invention.

The apparatus of the preferred embodiment of the present invention illustrated in the drawings is associated with a conventional draw frame, which requires no illustration here. The apparatus is used to replace sliver cans, and in the embodiment illustrated there are, for example, four slivers being drawn simultaneously from cans to the draw frame. Three full sliver cans 12, 13, 14 are arranged in a row adjacent to each other in a position of readiness, with another full sliver can 10 and three empty sliver cans 16, 17, 18 arrranged adjacent to each other in a row in sliver feeding positions parallel to the row of full cans 12, 13, 14. The readiness positions and the sliver feed positions are associated with each other in such a manner that the full sliver cans 12, 13, 14 can be engaged by piston-cylinder mechanisms 20 from their readiness positions and pushed into their sliver feed positins. In this operation the full cans 12, 13, 14 are shifted approximately transversely to the rows, as is shown by way of example with the engaged full sliver can 10 in FIG. 1.

The guiding and positioning of the full cans 12, 13, 14 during shifting from the ready position to the sliver feed position can be performed with the aid of pusher plates 21 attached to the piston-cylinder mechanisms 20. It would also be possible to utilize oblique roller trains with lateral guides for the full cans to feed into the sliver feed position. Stops can be provided to move into can engaging positions in the roller trains for positioning the sliver cans 12, 13, 14.

Figure 2:
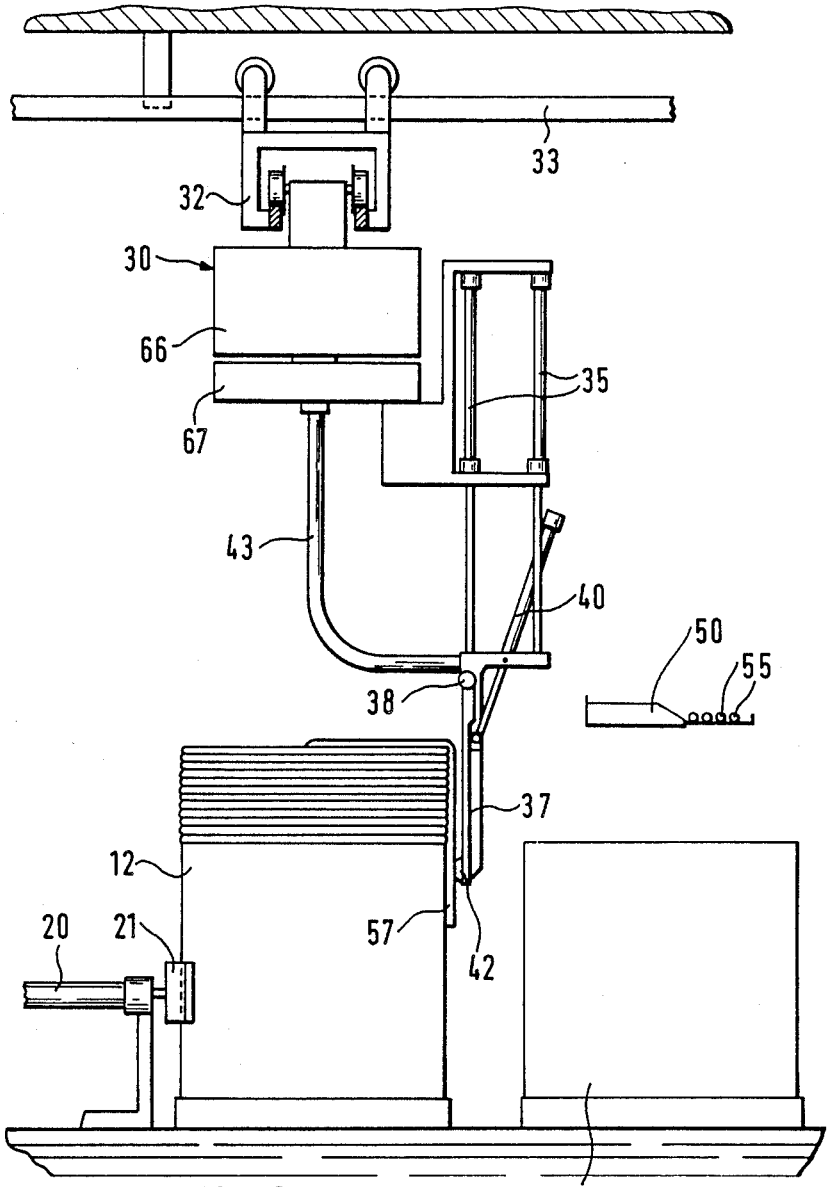
FIG. 2 is a side elevation of the apparatus of FIG. 1 illustrating the condition when a sliver end is being grasped.
Figure 3:
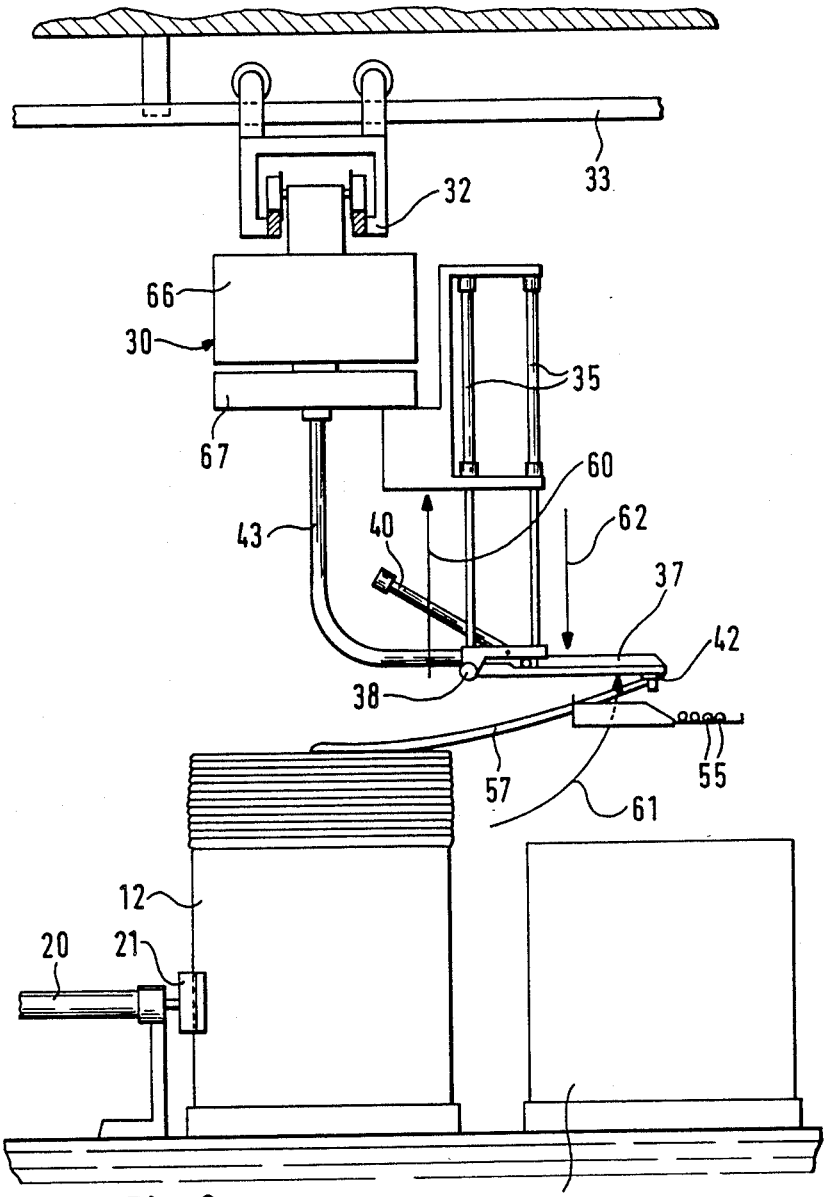
FIG. 3 is a view similar to FIG. 2 illustrating the grasping means in position for placing the sliver end onto the sliver feed table.

Referring to FIGS. 2 and 3, a carriage 30 is shown mounted for movement over the full cans 12, 13, 14 on a track system having longitudinal tracks 32 and transverse tracks 33 arranged at generally right angles to each other and fastened to the roof of the building in which the draw frame is located or to some other mounting structure. The carriage 30 can be coaxially positioned over each of the individual, full sliver cans 12, 13, 14 in their ready position and can be moved along the track system to perform similar functions at other draw frames.

The carriage 30 is divided into an upper non-rotatable part 66 and a lower rotatable part 67 that is mounted to the stationary part 66 for rotation about a vertical axis. The rotatable part 67 has two vertically positioned piston-cylinder mechanisms 35 mounted thereon at a spacing from the axis of rotation. An arm 37, serving as a gripper or a gripping means, and a pivoted piston-cylinder mechanism 40 are mounted at the lower ends of the pistons of the piston-cylinder mechanisms 35 so that the arm 37 can pivot about an approximatley horiznotal pivot shaft 38. In FIG. 2 arm 37 is shown in a vertically downward position and in FIG. 3 the arm 37 is shown approximately horizontal.

The pivot shaft 38 for the arm 37 is located in relation to the axis of rotation of the rotatable part 67 of the carriage 30 so that when the arm 37 is in its vertically downward position it is spaced only slightly from the periphery of the full can 12 located under the carriage 30. Thus, upon rotation of the rotatable part 67, the arm 37 moves or rotates around the periphery of the full can 12. The piston-cylinder mechanisms 35 have a stroke sufficient that the arm 37 can be raised for subsequent pivoting by the pivoted piston-cylinder mechanism 40 into a horizontal position without interference with the feed table 50 and can then be lowered into the position over the feed table 50 shown in FIG. 3.

Suction means of conventional construction mounted on carriage 30, through rigid hose 43, and extending between carriage and suction opening 42 in outer end of arm 37 applies a suction away from the can to draw a sliver in for grasping by the gripping means, which can be any conventional type of sliver gripping device.

The feed table 50, is attached to a supporting structure (not shown) and is positioned above the sliver cans 10, 16, 17, 18 in their sliver feed positions. The feed table 50 is arranged horizontally and forms a track for the feed of the slivers 55 removed from the sliver cans 10, 16, 17, 18 to the draw frame. Each sliver can 10, 16, 17, 18 in the feed position is associated with a feed roller 52 disposed approximatley horizontal on the feed table 50 for guiding the slivers 59 from the cans onto the feed table. This is illustrated by way of example in FIG. 1 for the full sliver can 10 in its sliver feed position. The direction of feed of the slivers 55 on the feed table 50 is indiated by arrow 64 in FIG. 1.

The method of the present invention using the above-described apparatus is as follows. It is assumed that the full sliver cans 12, 13, 14 are filled with sliver that has previously been prepared in a preceding processing operation and then transferred to the ready position illustrated with the sliver having an end 57 that hangs down on the outer wall of the can as shown in FIG. 2.

When the sliver cans that are in sliver feeding position under the feed table 50 are almost empty, e.g., when the sliver ends of the removed slivers are lying on the feed table 50, the draw frame and the feed of the slivers to the draw frame is stopped. Then, the empty can that is the farthest from the draw frame is replaced by a full can 10 as illustrated in FIG. 1. The replacement continues with the empty cans 16, 17, 18 being pushed out of the sliver feed position one after the other and the full cans 12, 13, 14 being advanced into the sliver feed positions.

Before each full can 12, 13, 14 is transferred to the sliver feed position, the carriage 30 is moved into position coaxially over the can so that the arm 37 is located between the full can 12 and the feed table 50. The arm 37, in its vertically downward position, is moved once around the can 12 by the rotation of the rotating part 67 of the carriage 30. In doing so, the arm 37 grasps the end of the sliver 57 with the aid of the aforementioned suction. The sliver end 57, drawn by suction into the opening 42, is sensed by a sensor, such as a light sensor. The sliver end 57 is then clamped by the arm 37 and any excess length of sliver is severed to provide a predetermined elngth of sliver end for feeding to the draw frame.

Then, the arm 37 is raised by the piston-cylinder mechanisms 35, pivoted outwardly by the pivoted piston-cylinder mechanism 40, and lowered by the piston-cylinder mechanisms 35 to position the end of the arm 37 with the grapsed sliver end 57 over the feed table 50. This condition is shown in FIGS. 1 and 3. The carriage 30 is then moved in a longitudinal direction to the next full sliver can 13, and in doing so the sliver end 57 is drawn over the associated feed roller 52 and placed onto the feed table 50, following which the arm 37 releases the sliver end 57, which falls onto the feed table 50.

Approximately simultaneously with or shortly after the movement of the carriage 30 to the position of the full can 13, the preceding full can 12 is pushed by the pusher plate 21 and piston-cylinder mechanism 20 into sliver feed position, and in doing so the can 12 pushes the empty can 16 out of sliver feed position.

The arm 37 is now returned to its vertical, downward position shown in FIG. 2 and the previously described method is repeated with the next sliver cans 13, 14.

The stopping of the draw frame before sliver can replacement and the described placing of the slivers onto the feed table 50 during the can replacement are timed in such a manner with one another that the sliver ends from the preceding cans and the sliver ends from the new cans overlap each other at least partially for a substantially precise predetermined length.

After all empty cans 16, 17, 18 have been replaced with full cans, the draw frame and, preferably, the driven feed rollers 52 are started back in operation. This has the result that the slivers 55 placed on the feed table 50 are again fed to the draw frame with the new sliver ends 55 form the full cans 10, 12, 13, 14 being transported by frictional engagement with the overlapping sliver ends from the previously emptied cans. This overlapping can be taken into consideration and compensated for in the draw frame by separation as waste or in some other conventional manner.

The full cans 12, 13, 14 can be positioned in the ready position by an operator manually and the empty cans 16, 17, 18 can likewise be manually removed. However, it is also possible to automatically feed full cans into the ready position and remove empty cans after they have been pushed out of sliver feed position. In this manner, a completely automatic replacement apparatus can be provided and can be controlled by a control device such as a microprocessor or the like, with no manual operation being necessary.

In a modified embodiment, the sliver ends 57 of the new slivers 55 are removed from the full cans 10, 12, 13, 14 and, rather than being placed on a feed table 15, are drawn by the arm 37 by movement of the carriage 30 in the direction of the draw frame until the sliver ends are over a sliver rack on which they are then deposited. This results in the sliver ends 57 of the slivers 55 being in a precise initial position when the draw frame is again started. This position can be taken into consideration in the draw frame by varying the draft so that the quality of the drawn sliver is improved.

In the preceding description, the draw frame is stopped for replacement of the sliver cans. However, it is possible, especially when replacing individual cans rather than replacing all of the cans, to allow the draw frame to continue to run. The deviations that occur due to replacement as a result of a briefly missing sliver can be compensated by the draw frame or by an autoleveller or separated out as waste.

It is advantageous according to the present invention to utilize sensing means for monitoring the emptying of the cans 10, 16, 17, 18 in the sliver feeding position. This can be done, e.g., by placing a mark on the spring plate of the cans 10, 16, 17, 18 that can be sensed by sensing means when the spring plate moves out of the can or when the sliver has been removed from the can to expose the marking. Then, the operating speed of the machine can be reduced when the sliver ends run out. Replacement can then be accomplished at the reduced speed so that the new sliver ends are placed in a timely manner on the old slivers without total stopping of operation of the draw frame. When all of the cans have been replaced, the draw frame is accelerated back to its normal operating speed.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for the purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method for replacing empty sliver cans with full sliver cans in a draw frame in which a plurality of slivers are fed from cans for processing in the draw frame, said method comprising positioning a full sliver can in readiness for replacing a can being emptied by the draw frame, and with an end of sliver exposed from the full can, positioning a movable carriage at the full can, grapsing the exposed end of sliver with a gripper carried on the carriage and placing the grasped sliver end into the draw frame by manipulating the gripper, and shifting the full can into sliver feeding position and the empty can out of sliver feeding position.

2. A method for replacing empty sliver cans with full sliver cans according to claim 1 and characterized further by moving the gripper around the periphery of the full can to assure grasping of the exposed sliver end.

3. A method for replacing empty sliver cans with full sliver cans according to claim 1 and characterized further by applying suction to draw the exposed sliver end to the gripper for grasping thereby.

4. A method for replacing empty sliver cans with full sliver cans according to claims 1, 2 or 3 and characterized further by severing any excess length of sliver from the grasped end of sliver before placing the sliver end into the draw frame.

5. A method for replacing empty sliver cans with full sliver cans according to claim 1 and characterized further in that said placing of the sliver end into the draw frame the sliver end is placed by the gripper onto a sliver feed table of the draw frame.

6. A method for replacing empty sliver cans with full sliver cans according to claim 5 and characterized further in that said placing of the sliver end into the draw frame the gripper is pivoted over the feed table.

7. A method for replacing empty sliver cans with full sliver cans according to claim 6 and characterized further in that in said placing of the sliver end into the draw frame the gripper is raised from adjacent the full can to above the level of the sliver feed table and is pivoted over the feed table.

8. A method for replacing empty sliver cans with full sliver cans according to claim 1 and characterized further in that in said shifting the full can pushes the empty can out of sliver feeding position.

9. A method for replacing empty sliver cans with full sliver cans according to claims 1 or 8 and characterized further in that said shifting a full can and an empty can are performed automatically.

10. A method for replacing empty sliver cans with full sliver cans according to claims 1 or 8 and characterized further in that said positioning a full sliver can and said shifting a full can and an empty can are performed automatically.

11. A method for replacing empty sliver cans with full sliver cans according to claim 1 or 5 and characterized further by sensing the emptying of sliver from the cans in sliver feeding position, and reducing the operating speed of the draw frame to reduce the rate of sliver feed during said placing of the sliver ends into the draw frame and said shifting of the cans.

12. Apparatus for replacing empty sliver cans with full sliver cans in a draw frame in which a plurality of slivers are fed from cans for processing in the draw frame and wherein the full sliver cans are in position in readiness for replacing cans being emptied with ends of sliver exposed from the full cans, said apparatus comprising a movable carriage, means for moving said carriage to positions at the full cans, sliver gripping means mounted on said carriage and operable to grasp the end of sliver exposed from a can at which said carriage is positioned and to place the sliver end into the draw frame, and means for shifting full sliver cans into sliver feeding position and empty cans out of sliver feeding position.

13. Apparatus for replacing empty sliver cans with full sliver cans in a draw frame according to claim 12 and characterized further by means for rotating said gripping means around the periphery of the full cans to assure grapsing of the exposed sliver end thereby.

14. Apparatus for replacing empty sliver cans with full sliver cans in a draw frame according to claim 12 and characterized further by means for creating suction in said gripping means to draw the exposed sliver end to said gripping means for grasping thereby.

15. Apparatus for replacing empty sliver cans with full sliver cans in a draw frame according to claim 12 and characterized further by sliver severing means in said gripping means for severing any excess length of sliver from the grapsed end of sliver before said gripping means places the sliver end into the draw frame.

16. Apparatus for replacing empty sliver cans with full sliver cans in a draw frame according to claim 12 and characterized further by means for raising said gripping means to lift the grapsed sliver end for placing into the draw frame.

17. Apparatus for replacing empty sliver cans with full sliver cans in a draw frame according to claim 16 and characterized further in that said raising means includes a vertically operable piston-cylinder mechanism.

18. Apparatus for replacing empty sliver cans with full sliver cans in a draw frame according to claim 12 and characterized further by means for pivoting said gripping means to position the grapsed sliver end for placing into the draw frame.

19. Apparatus for replacing empty sliver cans with full sliver cans in a draw frame according to claim 18 and characterized further in that said pivoting means includes a pivoted piston-cylinder mechanism.

20. Apparauts for replacing empty sliver cans with full sliver cans in a draw frame according to claim 16 and characterized further by means for pivoting said raised gripping means to position the grapsed sliver end for placing into the draw frame.

21. Apparatus for replacing empty sliver cans with full sliver cans in a draw frame according to claim 20 and characterized further in that said pivoting means includes a pivoted piston-cylinder mechanism.

22. Apparatus for replacing empty sliver cans with full sliver cans in a draw frame according to claim 12, 16, 17, 18, 19, 20 or 21 and characterized further by a sliver feed table on which slivers are fed from sliver cans into the draw frame, said feed table being disposed above the sliver cans that are being emptied.

23. Apparatus for replacing empty sliver cans with full sliver cans in a draw frame according to claim 12 and characterized further by means for guiding and positioning cans into said position in readiness.

24. Apparatus for replacing empty sliver cans with full sliver cans in a draw frame according to claim 12 and characterized further in that said can shifting means comprises means for pushing full cans into sliver feeding position and thereby cause full cans to push empty cans out of sliver feeding position.

25. Apparatus for replacing empty sliver cans with full sliver cans in a draw frame according to claim 24 and characterized further in that said pushing means includes piston-cylinder mechanisms and pusher plates operated by said piston-cylinder mechanisms against full cans to push the full cans into sliver feed position.

26. Apparatus for replacing empty sliver cans with full sliver cans in a draw frame according to claim 12 and characterized further by means for automatically positioning full cans in readiness and means for automatically removing empty cans.

27. Apparatus for replacing empty sliver cans with full sliver cans in a draw frame according to claim 12 and characterized further by means for guiding said carriage for operation at other draw frames.

* * * * *